US010309425B1

(12) United States Patent
Burgess

(10) Patent No.: US 10,309,425 B1
(45) Date of Patent: Jun. 4, 2019

(54) HIGH FLOW CAPACITY WELL FLUID EXTRACTION JET PUMP PROVIDING THROUGH ACCESS

(71) Applicant: Steven P. Burgess, Shreveport, LA (US)

(72) Inventor: Steven P. Burgess, Shreveport, LA (US)

( * ) Notice: Subject to any disclaimer, the term of this patent is extended or adjusted under 35 U.S.C. 154(b) by 332 days.

(21) Appl. No.: 15/239,512

(22) Filed: Aug. 17, 2016

Related U.S. Application Data

(60) Provisional application No. 62/207,436, filed on Aug. 20, 2015.

(51) Int. Cl.

| | |
|---|---|
| ***F04F 5/54*** | (2006.01) |
| ***E21B 43/12*** | (2006.01) |
| ***F04F 5/46*** | (2006.01) |
| ***F04F 5/10*** | (2006.01) |

(52) U.S. Cl.
CPC ..... *F04F 5/54* (2013.01); *E21B 43/124* (2013.01); *F04F 5/10* (2013.01); *F04F 5/46* (2013.01); *F04F 5/461* (2013.01); *F04F 5/464* (2013.01)

(58) Field of Classification Search
CPC ..... F04F 5/00; F04F 5/02; F04F 5/04; F04F 5/10; F04F 5/14; F04F 5/16; F04F 5/20; F04F 5/24; F04F 5/46; F04F 5/463; F04F 5/467; F04F 5/54; F04F 5/461; F04F 5/464; E21B 43/124
USPC ..... 417/151
See application file for complete search history.

(56) References Cited

U.S. PATENT DOCUMENTS

| | | | | |
|---|---|---|---|---|
| 4,664,603 | A | 5/1987 | Priestly | |
| 4,744,730 | A | 5/1988 | Roeder | |
| 4,753,577 | A | 6/1988 | Black et al. | |
| 5,083,609 | A * | 1/1992 | Coleman | E21B 43/124 166/105 |
| 6,354,371 | B1 * | 3/2002 | O'Blanc | E21B 43/124 166/154 |
| 7,909,089 | B2 | 3/2011 | Jackson | |
| 2007/0187111 | A1 | 8/2007 | Misselbrook et al. | |
| 2008/0314578 | A1 | 12/2008 | Jackson | |
| 2014/0003965 | A1 | 1/2014 | James | |

* cited by examiner

*Primary Examiner* — Alexander B Comley
*Assistant Examiner* — Chirag Jariwala
(74) *Attorney, Agent, or Firm* — R. Keith Harrison

(57) ABSTRACT

A hydraulically-retrievable, reversible flow operation jet pump threadably attached to a tubing string which is powered by fluid supplied through the tubing string. A pump housing, or container, of the jet pump includes a hollow cylinder with an internal diameter closely matching that of the attached tubing string. A jet pump assembly is retainably, scalably disposed within the pump housing. A jet pump reducing nozzle-mixing chamber-diffuser assembly is retainably disposed within the carrier. Power fluid pumped through the nozzle-mixing chamber-diffuser assembly conventionally draws in objective fluid in which the jet pump is immersed, and transports it out of the pump to the desired receiving station. The jet pump assembly can be oriented in either of two directions within the pump housing, for selected fluid direction flow.

18 Claims, 6 Drawing Sheets

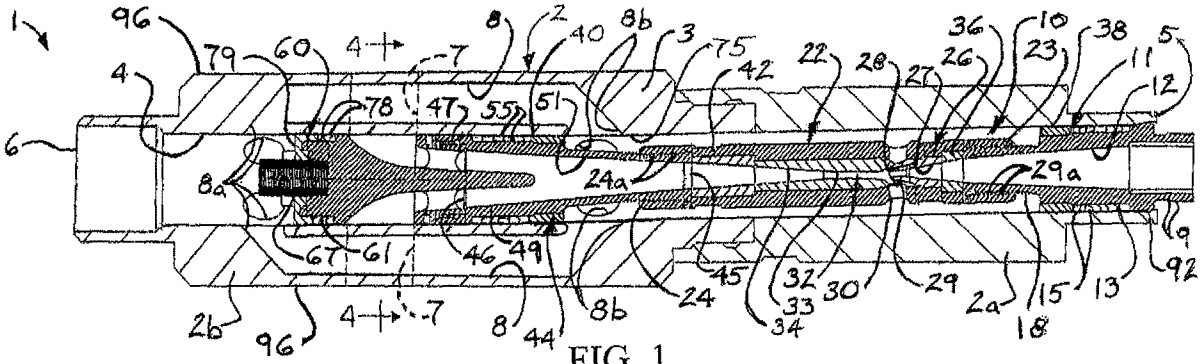
FIG. 1
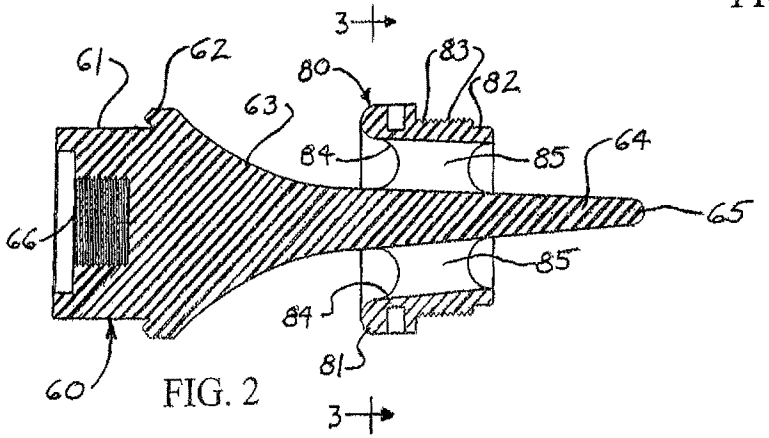
FIG. 2
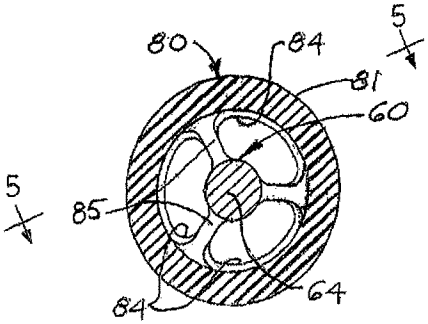
FIG. 3
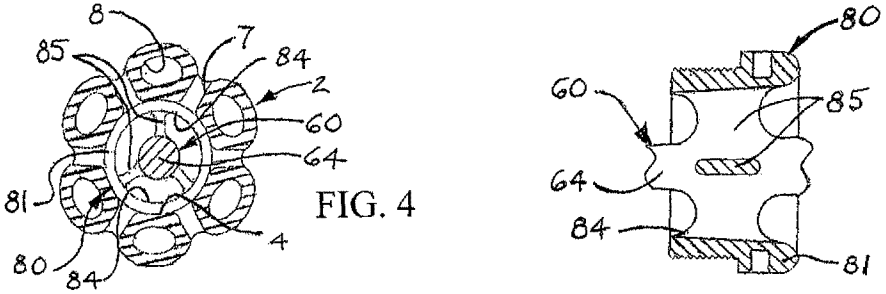
FIG. 4
FIG. 5

HIGH FLOW CAPACITY WELL FLUID EXTRACTION JET PUMP PROVIDING THROUGH ACCESS

CROSS-REFERENCE TO RELATED APPLICATIONS

This application claims the benefit of U.S. provisional application No. 62/207,436, filed Aug. 20, 2015 and entitled HIGH FLOW CAPACITY WELL FLUID EXTRACTION JET PUMP PROVIDING THROUGH ACCESS, which provisional application is incorporated by reference herein in its entirety, and this application is related to U.S. application Ser. No. 13/771,347, filed Feb. 20, 2013 and entitled WELL FLUID EXTRACTION JET PUMP PROVIDING ACCESS THROUGH AND BELOW PACKER.

FIELD

Illustrative embodiments of the disclosure generally relate to jet pumps. More particularly, illustrative embodiments of the disclosure relate to application of jet pumps used for artificial lift hydrocarbon well production applications. Illustrative embodiments of the disclosure further relate to methods of extracting well fluids from a subterranean well by operation of a high efficiency, high flow capacity, reversible operation, hydraulically-retrievable jet pump which allows maintenance access through the pump to well depths below the pump.

BACKGROUND

All methods of lifting gas, oil, or water from subterranean wells, referred to as "artificial lift", are utilized when the well is deficient of sufficient internal pressure to push the fluid to the ground surface. Of the long-established various methods of lift, the jet pump, or venturi, or eductor, has been sparingly utilized since the early twentieth century. They all work on the concept of conservation of energy, and subsequently, Bernoulli's Principle, stating that the total pressure head in an ideal non-compressible flowing fluid remains the same at any given point in the flow stream. So, by constricting the flow, as in a converging nozzle, the stream must flow faster. And, when flowing faster, Bernoulli's Principle illustrates that the associated stream pressure must decrease. This decrease is often utilized, as in a jet pump to draw in other objective fluids to be transported with the original stream.

A conventional jet pump generally includes a jet pump housing, a nozzle having a converging nozzle bore in the jet pump housing, a nozzle tip which communicates with the nozzle bore and terminates in a nozzle chamber, a mixing chamber which communicates with the nozzle chamber and a diverging passage called diffuser which communicates with the mixing chamber. As it flows through the nozzle, a pressurized power fluid creates a smaller, higher velocity stream which draws a suction fluid (the objective fluid) into the nozzle chamber and further into the mixing chamber. The mixed fluid velocity reduces in the diverging, diffuser passage following the mixing chamber, increasing the pressure of the fluid. The fluid mixture is transported to a selected station. Jet pumps are suitable for a variety of applications including downhole well applications in which the pumps may be used to retrieve well reservoir fluid containing hydrocarbons to the well surface.

In typical downhole hydrocarbon production applications, the jet pump housing of a jet pump is directly or indirectly attached to a tubing string which is inserted in a well bore, above but in a line connected with the packer, a common device long utilized by those skilled in the art. Power fluid is pumped from the ground surface through the tubing string into the jet pump. As the power fluid flows through the nozzle in the jet pump housing, reservoir fluid from the well bore is drawn from below the packer, through the standing valve 102 (or safety valve, known by those skilled in the art) into the jet pump via a pressure drop generated by the power fluid exiting the nozzle. This reservoir fluid mixes with the power fluid. The fluid mixture, which includes power fluid and reservoir fluid, flows through the jet pump to the well annulus area between the pump housing and well casing to the well surface or up the tubing string in case of reverse flow.

One of the limitations of conventional jet pumps which are used in hydrocarbon well production applications is that the diffuser and/or other components of the jet pump may be immovably attached to the jet pump housing. Consequently, these components hinder downhole cleaning and/or maintenance operations in the well bore below the pump and thus, the tubing string must be removed from the well bore for jet pump housing removal in order to perform these operations. One exception to this is the use of a smaller size conventional jet pump mounted inside a sleeve. This sleeve matches the O.D. and I.D. of the tubing string. This smaller jet pump is removable/retrievable in its entirety by wireline, thereby leaving maintenance to the well below the pump.

In subterranean wells, the jet pump flow stream, or power fluid, is pumped from the ground surface and may include water, oil or gas. The generated Venturi pressure drop is used to draw in reservoir fluid, and the surface pump pressure pushes the combined power fluid and reservoir fluid to the surface where the two are separated, and the operation of artificial lift is continuous.

Standards within the well drilling and production industries have evolved over time, and these standards apply to safety and convenience. The standards include specifications for well casing and tubing and the relationships these have to each other in size. So, for any given well, there are established ranges of dimensions for the production tubing or tubing string and the casing. These fixed dimensions set the limits for tooling sizes such as those for jet pumps. By design, jet pumps operate at very high fluid flow velocities. These flow velocities, in combination with differing well conditions. frequently produce undesirable and often unpredictable undesirable effects on the mechanical components of jet pumps. Downhole reservoir condition variables can include varying fluids constituencies, fluid constituency percentages variation, entrapped gasses, high temperatures, high and varying pressures, corrosives, and solid contaminants, some of which can be very abrasive.

In consideration of all of these well variables, along with the need to minimize the cost of operating the jet pump and lifting the combined fluids to the surface, the jet pump design becomes a very important factor in the operation. Jet pumps often require 3000 to 4500 psi power fluid surface pump pressure to operate, combined with another 3000 to 4500 psi to lift the fluid to the surface. Production capacities for jet pump wells can vary widely but frequently reach 4000 barrels per day. and can reach more. The result is a surface pump system which is large and quite costly. In addition to this. the cost of electrical power to operate the surface pump system can be substantial, particularly in times of economically depressed commodity prices.

Therefore, it becomes imperative for the jet pump to operate as efficiently as possible, reliably, and uninterrupted for as long as possible. Maintaining operational efficiency of a well requires constant attention to the well variables. As the variables change, there can be differing production equipment demands. Performance of jet pumps is directly related to the component sizes and resulting output stream magnitude. Also, conditions of the well often impart abrasive wear or erosion on jet pump components. These conditions necessitate maintenance, and accordingly, retrieval of the jet pump to the surface. All of this work must be performed as efficiently as possible.

Because subterranean formations are dynamic, wells require maintenance. As discussed above, there can be a variety of effects to the casing and production tubing from natural reservoir activity. Results may include plugging of the well, perforations, safety valve or standing valve (check valve), or simply buildup of paraffin or scale on the tubing surfaces, along with a host of other maintenance-requiring occurrences. These conditions require clear access through the tubing and jet pump to the lower well depths.

Some wells exhibit casing which may be old and deteriorated or may be vulnerable to abrasive/corrosive contaminant entrained reservoir fluid flow. Conventional jet pump-configured wells operate by surface power fluid pumped down the production tubing, and this along with production fluids lifted in the annulus between the tubing and the casing. Where this is not allowed due to casing erosion concerns, the reverse procedure must be utilized. Therefore, optimum design of a jet pump should include features in addition to good metallurgical practices for long erosion, corrosion, and abrasive wear life as follows:

1. Simple design with no moving, and minimal number of components;
2. Through-flow hydraulically optimized, with fewest fluid turns, most gradual turns, most gradual divergences, minimal laminar flow interruptions and largest flow port cross-sectional areas possible;
3. Capability of efficient reversing of the jet pump assembly (nozzle and mixing tube) for lifting production fluid up either the annulus or the tubing;
4. Capability of reliable, efficient, ordinary, and possible frequent removal of the jet pump assembly, while in the well, leaving the unobstructed bore of the jet pump housing, which dimensionally closely matches the internal diameter of the connecting production tubing;
5. Performance which minimizes surface pump power requirements; and
6. Results in maximum possible production.

Accordingly, this invention describes a high flow capacity reversible operation jet pump which includes a housing that is attached to a tubing string and from which a jet pump assembly including the functional components of the jet pump can be selectively removed from the housing while the housing remains in place in the tubing string, allowing for unobstructed cleaning and/or maintenance of the well bore. A high flow capacity reversible operation jet pump which includes a jet pump assembly that can be selectively re-oriented in the jet pump housing to facilitate reversible operation, in combination with the fore-stated through accessibility, of the jet pump is included. The jet pump is streamline improved for more efficient flow. Flow through the jet pump exhibits reduced velocities via larger flow ports, as suction ports are located inside the housing walls away from the jet pump assembly.

SUMMARY

An illustrative embodiment of a through-accessible and high flow capacity reversible operation jet pump for attachment to a tubing string includes a pump housing including a pump housing wall and a pump housing interior in the pump housing wall. At least one suction port is in the pump housing wall. The at least one suction port has a suction port inlet and a suction port outlet disposed in fluid communication with the pump housing interior. A jet pump assembly is disposed in the pump housing interior. The jet pump assembly includes a proximal carrier head disposed in sealing engagement with the pump housing wall, a carrier disposed in fluid communication with the proximal carrier head, a carrier nozzle in the carrier, at least one carrier opening in the carrier and establishing fluid communication between the carrier nozzle and the suction port outlet of the at least one suction port through the pump housing interior, a distal carrier head disposed in sealing engagement with the pump housing wall and having a distal carrier head bore disposed in fluid communication with the carrier and a pump spool having a tapered spool shaft terminating inside the distal carrier head bore of the distal carrier head. The pump spool is disposed in sealing engagement with the pump housing wall between the suction port inlet and the suction port outlet of the at least one suction port.

BRIEF DESCRIPTION OF THE DRAWINGS

Illustrative embodiments of the disclosure will now be described, by way of example, with reference to the accompanying drawings, in which:

FIG. 1 is a longitudinal sectional view of an illustrative embodiment of the through-accessible high flow capacity reversible operation jet pump, more particularly illustrating a first configuration of the pump in which a jet pump assembly is oriented in a first orientation in a pump housing and power fluid (not illustrated) flows in a first direction through the pump;

FIG. 2 is a longitudinal sectional view of a pump spool component of the jet pump assembly of the through-accessible high flow capacity reversible operation jet pump;

FIG. 3 is a cross-sectional view of a spool collar of the pump spool, taken along section lines 3-3 in FIG. 2;

FIG. 4 is a cross-sectional view of the pump housing and pump spool of the through-accessible high flow capacity reversible operation jet pump, taken along section lines 4-4 in FIG. 1;

FIG. 5 is a longitudinal sectional view, taken along section lines 5-5 in FIG. 3, of a typical collar vane in the spool collar;

DETAILED DESCRIPTION

Figure 6:
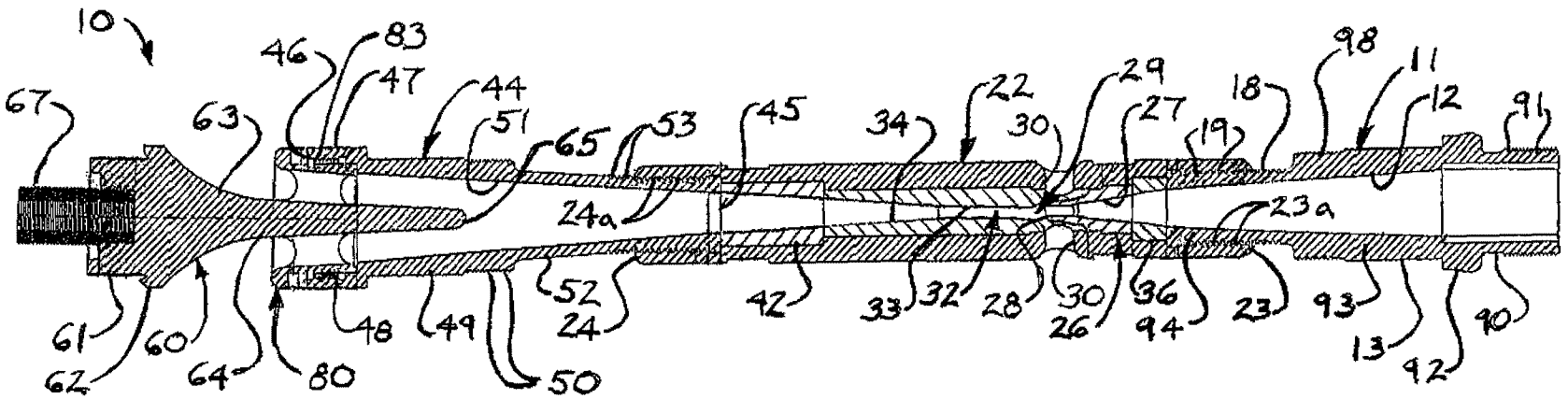
FIG. 6 is a longitudinal sectional view of a typical jet pump assembly of the through-accessible high flow capacity reversible operation jet pump, removed from the pump housing.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "upper", "lower", "above", 'below", "top", "horizontal" and "vertical" as used herein are intended for descriptive purposes only and are not necessarily intended to be construed in a limiting sense. As used herein, the term "proximal" means "closer to the well surface" whereas the term "distal" as used herein means "further from the well surface".

Referring initially to FIGS. 1-6 and 7B of the drawings, an illustrative embodiment of the well fluid extraction through-accessible high flow capacity reversible operation jet pump providing unobstructed access through and below packer and/or the jet pump, hereinafter jet pump, is generally indicated by reference numeral 1 in FIG. 1. The jet pump 1 includes a pump housing 2. The pump housing 2 includes a pump housing wall 3 which may be generally elongated and cylindrical. The pump housing wall 3 of the pump housing 2 has a pump housing interior 4. The pump housing 2 may have a proximal housing end 5 and a distal housing end 6 at opposite ends of the pump housing interior 4. At least one pump housing opening 7 may extend through the pump housing wall 3 of the pump housing 2 in fluid communication with the pump housing interior 4 for purposes which will be hereinafter described. As further illustrated in FIG. 1, in some embodiments. the pump housing 2 may include an upper or proximal housing portion 2*a* and a lower or distal housing portion 2*b* which is sealingly coupled to the proximal housing portion 2*a* via threading or otherwise according to the knowledge of those skilled in the art. In other embodiments, the pump housing 2 may be fabricated in one piece. A jet pump assembly 10 is disposed in the pump housing interior 4 of the pump housing 2 for purposes which will be hereinafter described.

As illustrated in FIG. 1, multiple suction ports 8 may extend through and along a distal portion of the pump housing wall 3 of the pump housing 2. The suction ports 8 may be oriented in generally parallel relationship to the longitudinal axis of the pump housing 2. As illustrated in FIG. 4. in cross-sectional view, the suction ports 8 may be arranged in spaced-apart relationship to each other around the circumference of the pump housing 2. Accordingly, the suction ports 8 may form longitudinally-extending undulations 96 which are spaced about the circumference in the exterior surface or O.D. (Outer Diameter) of the pump housing wall 3 of the pump housing 2 to maximize the cross-sectional area for flow of fluid within the pump housing interior 4. The undulations 96 may correspond in number and position to the respective suction ports 8 in the pump housing 2. Each suction port 8 may have a suction port inlet 8*a* and a suction port outlet 8*b*. The suction port inlet 8*a* may be disposed in fluid communication with the portion of the pump housing interior 4 which is below or distal to the jet pump assembly 10. The suction port outlet 8*b* may be disposed in fluid communication with an annular reservoir fluid flow space 75 in the pump housing interior 4. The fluid flow space 75 may be formed by and between the interior surface of the pump housing wall 3 and the exterior surface of the jet pump assembly 10.

The jet pump assembly 10 is selectively removable from the pump housing interior 4 for purposes which will be hereinafter described. As particularly illustrated in FIG. 6, the jet pump assembly 10 may include an upper or proximal carrier head 11 which is normally generally proximate the upper or proximal housing end 5 of the pump housing 2 (FIG. 1). The upper or proximal carrier head 11 has a proximal carrier head bore 12.

As further illustrated in FIG. 6, in some embodiments, the proximal carrier head 11 of the jet pump assembly 10 may include a proximal carrier head base 90. The proximal carrier head base 90 may have exterior base threads 91 which facilitates coupling of the pump housing 2 to a setting tool 88 (not shown but understood by those skilled in the art) in installation of the jet pump 1 in the well casing 70, which will be hereinafter described. An annular flared housing contact portion 92 (referred to as "go-no-go contact seal" in the industry) may protrude outwardly from the proximal carrier head base 90. A proximal carrier head body 93 may extend from the flared portion 92. The proximal carrier head body 93 may have exterior body threads 98 for purposes which will be hereinafter described. A proximal carrier head neck 18 may extend from the proximal carrier head body 93 for attachment purposes as will be hereinafter described. The proximal carrier head neck 18 may have exterior neck threads 19 for purposes which will be hereinafter described.

As illustrated in FIG. 1, at least one proximal seal 15 may be sandwiched between a proximal carrier head outer surface 13 of the proximal carrier head 11 and an interior surface of the pump housing interior 4 to impart a fluid-tight seal between the proximal carrier head 11 and the pump housing wall 3. An interiorly-threaded proximal seal retaining collar 38 may be threaded on the exterior body threads 98 on the proximal carrier head body 93 of the proximal carrier head 11 to retain the proximal seals 15 in place.

The jet pump assembly 10 may further include a lower or distal carrier head 44. As illustrated in FIG. 6, the lower or distal carrier head 44 may have an upper or proximal head end 45 and a lower or distal head end 46 and a distal carrier head bore 51 which diverges from the proximal head end 45 to the distal head end 46. In some embodiments, the distal carrier head 44 may include a distal carrier head base 47. The distal carrier head base 47 may have interior base threads 48 for purposes which will be hereinafter described. A distal carrier head body 49 may extend from the distal carrier head base 47. Exterior body threads 50 may be provided on the distal carrier head body 49 for purposes which will be hereinafter described. A distal carrier head tapered portion 52 may extend from the distal carrier head body 49. Exterior distal carrier head threads 53 may be provided on the distal carrier head tapered portion 52 for purposes which will be hereinafter described.

As illustrated in FIG. 1, at least one middle seal 55 may be sandwiched between the exterior surface of the distal carrier head body 49 and the interior surface of the pump housing interior 4 to impart a fluid-tight seal between the distal carrier head 44 and the interior surface of the pump housing wall 3. An interiorly-threaded middle distal seal retaining collar 40 may be threaded on the exterior body threads 50 (FIG. 6) on the distal carrier head body 49 of the distal carrier head 44 to retain the middle seals 55 in place.

As illustrated in FIG. 6, the jet pump assembly 10 may include a pump spool 60 which is coupled to the distal carriage head 44. As particularly illustrated in FIG. 2, the pump spool 60 may include a spool base 61. The spool base 61 may have an interiorly-threaded spool bushing opening 66 which threadably receives a spool bushing 67 (FIG. 6). An annular flared housing contact portion 62 may protrude from the spool base 6I. A tapered spool body 63 may extend from the flared spool portion 62. An elongated, tapered spool shaft 64 having a spool tip 65 may extend from the spool body 63.

A spool collar 80 accommodates the spool shaft 64 of the pump spool 60. The spool collar 80 may include an annular spool collar base 81. A cylindrical spool collar wall 82 may extend from the spool collar base 81. The spool collar wall 82 may have exterior spool collar threads 83. Fluid flow spaces 84 may extend through the spool collar base 81 and the spool collar wall 82. Multiple collar vanes 85 may separate adjacent fluid flow spaces 84 from each other. The collar vanes 85 may attach the spool collar wall 82 to the spool shaft 64 of the pump spool 60.

As illustrated in FIG. 6, the spool collar 80 on the pump spool 60 may be coupled to the distal carrier head base 47 of the distal carrier head 44 by threaded engagement of the exterior spool collar threads 83 on the spool collar 80 with the companion interior base threads 48 in the distal carrier head base 47 of the distal carrier head 44. Accordingly, the spool tip 65 of the pump spool 60 terminates inside the distal carrier head bore 51 of the distal carrier head 44. As illustrated in FIG. 1, at least one distal seal 78 may be sandwiched between the spool base 61 of the pump spool 60 and the pump housing wall 3 of the pump housing 2. A distal seal retaining collar 79 may threadably engage the spool base 61 to retain the distal seals 78 in place.

As further illustrated in FIG. 6, the jet pump assembly 10 may include a carrier 22 which is detachably coupled to and extends between the proximal carrier head 11 and the distal carrier head 44. The carrier 22 can be selectively attached to the proximal carrier head 11 and the distal carrier head 44 in a first orientation (FIGS. 1, and 7A and 7B) to facilitate flow of fluid through the jet pump assembly 10 in a downward direction. The carrier 22 can be selectively detached from and then re-attached to the proximal carrier head 11 and the distal carrier head 44 in a second orientation (FIGS. 8A and 8B) to facilitate flow of fluid through the jet pump assembly 10 in an upward direction for purposes which will be hereinafter described. The carrier 22 may have a carrier inlet end 23 and a carrier outlet end 24. The carrier inlet end 23 may have interior inlet threads 23*a* and the carrier outlet end 24 may have interior outlet threads 24*a* for attachment purposes as will be hereinafter described.

A carrier nozzle 26 is disposed inside the carrier 22 and includes a nozzle bore 27 which converges towards the carrier outlet end 24. As illustrated in FIG. 7B, a nozzle tip 28 terminates the nozzle bore 27. A nozzle chamber 29 in the carrier 22 communicates with the nozzle tip 28. At least one carrier opening 30 in the carrier 22 establishes communication between the nozzle chamber 29 and the reservoir fluid flow space 75 in the pump housing interior 4 of the pump housing 2. As illustrated in FIG. 6, in some embodiments, a nozzle spacer 36, having a tapered nozzle spacer bore (not numbered) which converges toward the carrier outlet end 24 of the carrier 22, may be disposed between the tapered converging proximal carrier head bore 12 of the proximal carrier head 11 and the converging nozzle bore 27 of the carrier nozzle 26. The nozzle spacer 36 imparts smooth continuity between the interior surface of the proximal carrier head bore 12 and the interior surface of the converging nozzle bore 27 of the carrier nozzle 26.

A mixing chamber 32 communicates with the nozzle chamber 29. The mixing chamber 32 may include a straight chamber segment 33 which extends from the nozzle chamber 29 and a diverging chamber segment 34 which extends from the straight chamber segment 33. The diverging chamber segment 34 may terminate generally at or adjacent to the interior outlet threads 24*a* of the carrier 22. In some embodiments, a mixing chamber spacer 42, having a tapered mixing chamber spacer bore (not numbered) which diverges toward the carrier outlet end 24, may be disposed between the tapered diverging chamber segment 34 of the mixing chamber 32 and the diverging distal carrier head bore 51 of the distal carrier head 44. The mixing chamber spacer 42 imparts smooth continuity between the interior surface of the diverging chamber segment 34 and the interior surface of the diverging distal carrier head bore 51 of the distal carrier head 44.

Figure 7A:
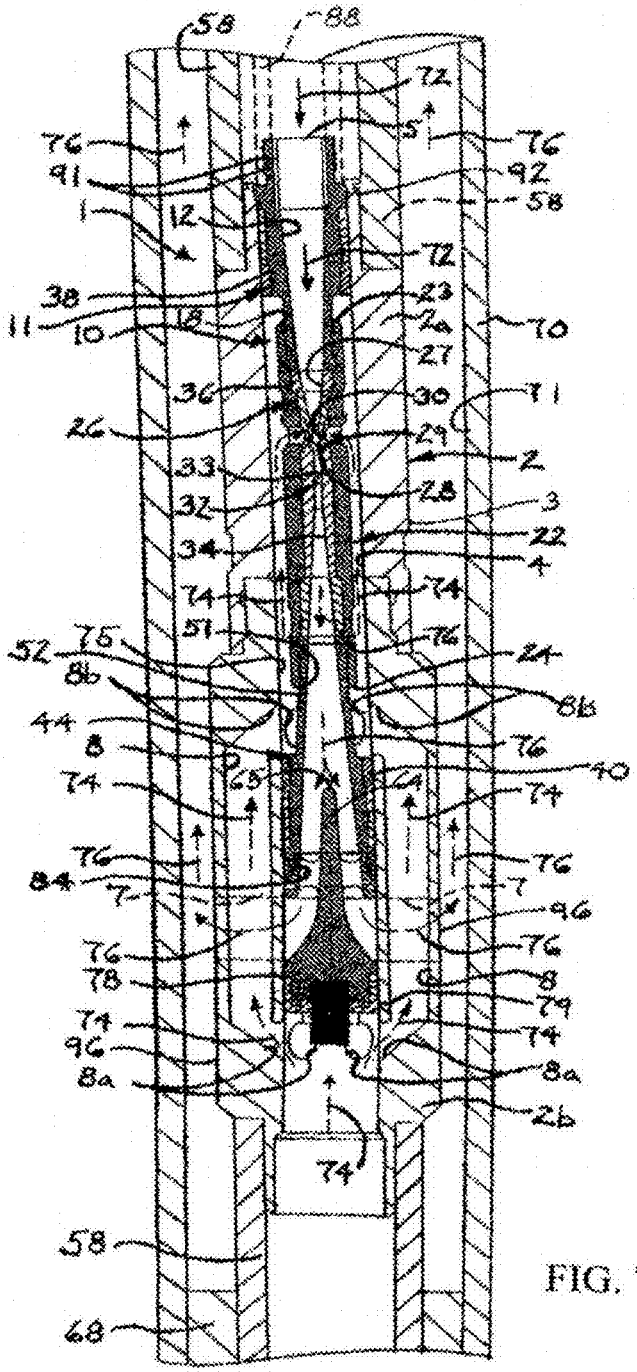
FIG. 7A is a longitudinal sectional view of the through-accessible high flow capacity reversible operation jet pump, deployed in a well casing in a subterranean well with the jet pump assembly oriented in the first orientation, more particularly illustrating flow of power fluid downwardly through the jet pump and then into and upwardly through the annulus between the well casing and the jet pump housing to the well surface, respectively, to draw reservoir fluid from the well to the well surface with the power fluid in a typical first fluid flow direction operational mode of the pump.
Figure 7B:
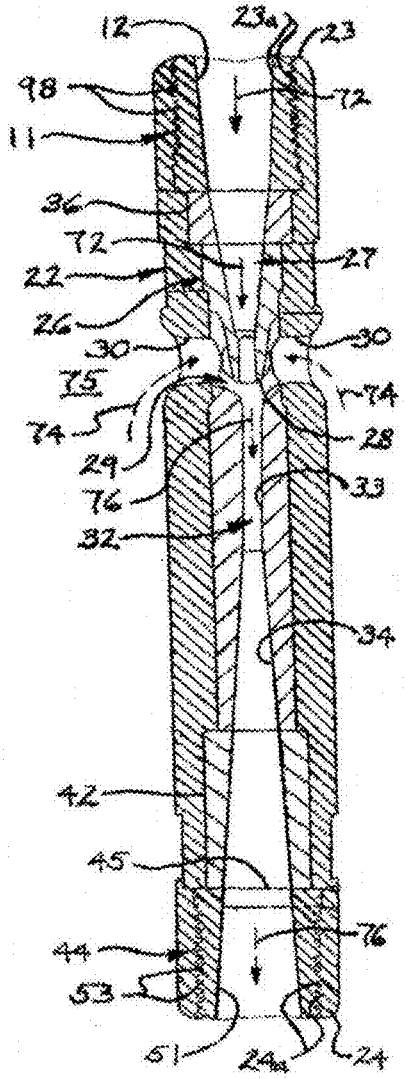
FIG. 7B is an enlarged longitudinal sectional view of a typical carrier nozzle-mixing tube assembly inside the jet pump assembly, oriented in the first orientation of FIG. 7A, more particularly illustrating flow of power fluid and reservoir fluid in the carrier nozzle-mixing tube assembly in the first fluid flow direction operational mode of the through-accessible high flow capacity reversible operation jet pump.
Figure 8A:
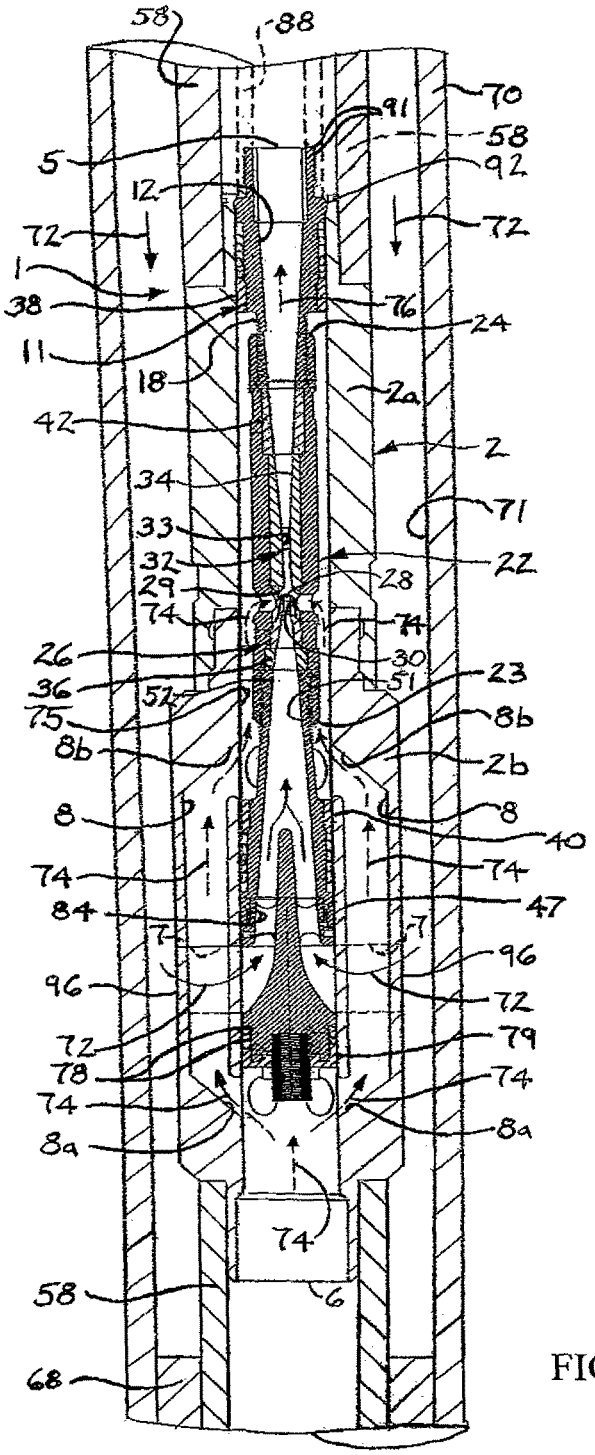
FIG. 8A is a longitudinal sectional view of the through-accessible high flow capacity reversible operation jet pump, deployed in a well casing in a subterranean well with the jet pump assembly oriented in the second orientation, more particularly illustrating flow of power fluid downwardly through the annulus between the pump housing and the well casing and then into and upwardly through the jet pump to the well surface, respectively, to draw reservoir fluid from the well to the well surface with the power fluid in a typical second fluid flow direction operational mode of the pump.

Referring next to FIGS. 7A, 7B, 8A and 8B of the drawings, in exemplary application, the jet pump 1 is attached to a tubing string 58 and inserted in a well casing 70 deployed in a subterranean hydrocarbon well to extract, or artificial lift reservoir fluid 74 from the well. The reservoir fluid 74 which is extracted from the well may include water as well as hydrocarbons. At the well surface, the hydrocarbons may be separated from the extracted reservoir fluid 74 using techniques which are well known by those skilled in the art. In some applications, the well casing 70 may be disposed in a vertical orientation, as illustrated in FIGS. 7A and 8A. Thus, the following description is based on a vertical orientation of the well casing 70 in the subterranean hydrocarbon well. It is to be understood, however, that in other applications, the well casing 70 may be disposed in a horizontal orientation or in any orientation between a vertical orientation and a horizontal orientation.

At the well surface, the pump housing 2 of the reversible operation jet pump 1 may be attached to the tubing string 58 typically via a threaded coupling (not illustrated). The pump housing 2 and tubing string 58 are lowered into the well casing 70. At the desired depth, the packer 68 may have been deployed in the well casing 70 typically by extending gripping elements (not illustrated) from the packer 68 which engage the well casing 70 typically via rotation of the tubing string 58 in the conventional manner. A setting tool 88 may be threadably coupled to the exterior base threads 91 on the proximal carrier head base 90 of the jet pump assembly 10 to facilitate placement of the jet pump assembly 10 in the pump housing 2 when not set in place initially and, in some cases, extraction of the jet pump assembly 10 from the pump housing 2.

As illustrated in FIGS. 7A and 7B, in a first fluid flow direction operational mode of the jet pump 1, the carrier 22 of the jet pump assembly 10 may be configured in a first orientation in the pump housing interior 4 to facilitate downward flow of power fluid 72 (which may include water and/or oil, for example and without limitation) from the well surface through the tubing string 58 and the jet pump assembly 10, respectively, and upward flow of a fluid mixture 76 of power fluid 72 and reservoir fluid 74 to the well surface through the well annulus 71 between the pump housing 2 and the well casing 70. As illustrated in FIG. 8A, in a second fluid flow direction operational mode of the reversible operation jet pump 1, the carrier 22 of the jet pump assembly 10 may be configured in a second orientation in the pump housing interior 4 to facilitate downward flow of power fluid 72 from the well surface through the well annulus 71 and upward flow of a fluid mixture 76 of power fluid 72 and reservoir fluid 74 to the well surface through the jet pump assembly 10 and the tubing string 58, respectively. The jet pump assembly 10 is selectively configured in the first orientation (FIG. 7A) by orienting the carrier 22 such that the carrier nozzle 26 accommodates downward flow of power fluid 72 through the jet pump assembly 10. This is accomplished by coupling the carrier inlet end 23 of the carrier 22 to the proximal carrier head neck 18 of the proximal carrier head 11 and coupling the carrier outlet end 24 of the carrier 22 to the distal carrier head tapered portion 52 of the distal carrier head 44. The jet pump assembly 10 is selectively configured in the second orientation (FIG. 8A) by orienting the carrier 22 such that the carrier nozzle 26 accommodates upward flow of power fluid 72 and reservoir fluid 74 through the jet pump assembly 10. This is accomplished by coupling the carrier inlet end 23 of the carrier 22 to the distal carrier head tapered portion 52 of the distal carrier head 44 and coupling the carrier outlet end 24 of the carrier 22 to the proximal carrier head neck 18 of the proximal carrier head 11.

In either fluid flow direction operational mode of operation, as the reversible operation jet pump 1 is inserted in place in the well casing 70 on the tubing string 58, the reservoir fluid 74 in the well flows upwardly through the lower portion of the pump housing interior 4, the suction ports 8 and the reservoir fluid flow space 75 in the pump housing 2. The reservoir fluid flow space 75 generally surrounds the carrier 22, including the carrier openings 30 which establish fluid communication between the pump housing interior 4 and the nozzle chamber 29.

In the first fluid flow direction operational mode of operation (FIGS. 7A and 7B) of the reversible jet pump 1, power fluid 72 is pumped downwardly through the tubing string 58 and the jet pump assembly 10, respectively. Accordingly, as particularly illustrated in FIG. 7B, the power fluid 72 flows through the proximal carrier head bore 12 of the proximal carrier head 11 and the converging nozzle bore 27, the nozzle tip 28 and the nozzle chamber 29, respectively, of the carrier nozzle 26. In the mixing chamber 32, the power fluid 72 mixes with reservoir fluid 74 and the resulting fluid mixture 76 flows through the distal carrier head bore 51 of the distal carrier head 44. As illustrated in FIG. 7A, from the distal carrier head bore 51, the fluid mixture 76 flows around the spool tip 65 and spool shaft 64 of the pump spool 60 and then through the fluid flow spaces 84 (FIG. 3) in the spool collar 80, respectively, and then through the pump housing openings 7 in the pump housing 2 and into the well annulus 71, respectively.

As illustrated in FIG. 7B, as the power fluid 72 flows through the converging nozzle bore 27 of the carrier nozzle 26, the pressure of the power fluid 72 drops substantially as the fluid velocity increases as the fluid is discharged from the nozzle tip 28 into the nozzle chamber 29. A vacuum, or reduced pressure which is generated after the nozzle tip outlet 28, and in the mixing chamber 32 by the flowing power fluid 72 is at lower pressure than the pressure of the reservoir fluid 74 in the reservoir fluid flow space 75. Consequently, the reservoir fluid 74 is drawn from the reservoir fluid flow space 75 into the nozzle chamber 29 through the carrier openings 30, via the power fluid-generated pressure drop in the mixing chamber 32, and mixes with the flowing power fluid 72. forming a fluid mixture 76 which includes the power fluid 72 and the reservoir fluid 74. As it flows through the mixing chamber 32, the pressure of the fluid mixture 76 remains low and then increases again as the fluid mixture 76 flows first through the diverging chamber segment 34 of the mixing chamber 32 and then through the distal carrier head bore 51 of the distal carrier head 44, respectively. As further illustrated in FIG. 7A, the fluid mixture 76 initially flows from the distal carrier head bore 51 through the fluid flow spaces 84 (FIG. 3) in the spool collar 80 of the pump spool 60, and then turns outwardly and flows through the pump housing openings 7 in the pump housing 2 and into and through the well annulus 71, respectively, to the well surface. At the well surface, the hydrocarbons may be separated from the power fluid 72 and the reservoir fluid 74 using techniques which are known by those skilled in the art.

Due to the drop in pressure of the reservoir fluid 74 in the reservoir fluid flow space 75, caused by flow of the power fluid 72 from the nozzle tip 28 and through the nozzle chamber 29 and mixing chamber 32, respectively, reservoir fluid 74 flows from the fluid flow space 75 into the nozzle chamber 29 through the carrier openings 30. In the straight chamber segment 33 of the mixing chamber 32, the reservoir fluid 74 mixes with the power fluid 72 and forms the fluid mixture 76. Consequently, reservoir fluid 74 continues to flow from the well through the suction ports 8 into the fluid flow space 75 in the pump housing interior 4. Throughout operation of the reversible operation jet pump 1 in the first fluid flow direction operational mode, the velocity head, or downward pressure of the flowing power fluid 72, along with the weight of the jet pump assembly 10, maintains the jet pump assembly 10 deployed in place in the pump housing 2.

As the fluid mixture 76 flows from the distal carrier head bore 51 of the distal carrier head 44 through the fluid flow spaces 84 in the spool collar 80, the spool shaft 64 of the pump spool 60 acts as a flow splitter which facilitates uniform, smooth and even flow of the fluid mixture 76 through the spool collar 80 throughout the circumference of the pump spool 60. The curved surfaces of the spool body 63 direct the fluid mixture 76 in a continuously smooth, approximately linear, non-turbulent and gradually outward fluid flow path from the straight flow path through the fluid flow spaces 84 in the spool collar 80 and then to the outward flow path through the pump housing openings 7 in the pump housing 2, respectively, and into the well annulus 71. Thus, the combined effects of the spool shaft 64 and the spool body 63 reduce or minimize turbulent or uneven flow of the fluid mixture 76, facilitating steady flow of a large volume of the fluid mixture 76 through the well annulus 71 to the well surface. This expedient together with large suction ports located in the housing wall 3 provides a substantially greater capacity for fluid flow within the jet pump 1 for a given cross-sectional area for the jet pump than can be achieved using conventional pump designs. Consequently, a substantially greater volume of flowing fluid and a substantial reduction in power fluid pump horsepower and in jet pump erosion can be achieved within a given pump cross-sectional area for efficient removal of the reservoir fluid 74 from the well.

In some applications, the reservoir fluid 74 may carry sand and/or other particulate matter or corrosives which may have a tendency to abrade or corrode the well casing 70 as the fluid mixture 76 which contains the reservoir fluid 74 is ejected from the pump housing openings 7 into the well annulus 71 and as it flows through the well annulus 71 to the well surface. In such applications, therefore, it may be desirable to operate the reversible operation jet pump 1 in the second fluid flow direction operational mode in which the reservoir fluid 74 is pumped to the well surface after it flows through the jet pump 1 instead of through the well annulus 71. Accordingly, as illustrated in FIG. 8A, the carrier 22 is configured in the second orientation in the jet pump assembly 10 such that the carrier nozzle 26 accommodates upward flow of the fluid mixture 76 (which includes the power fluid 72 and the reservoir fluid 74) through the jet pump assembly 10.

Reservoir fluid 74 initially flows from the well into the pump housing interior 4 through the suction ports 8 into the reservoir fluid flow space 75 and surrounds the carrier 22. Power fluid 72 is pumped downwardly through the well annulus 71. The power fluid 72 flows from the well annulus 71 through the pump housing openings 7 and turns upwardly and flows through the fluid flow spaces 84 (FIG. 3) in the spool collar 80, respectively, into the distal carrier head bore 51 of the distal carrier head 44. From the distal carrier head bore 51, the power fluid 72 flows upwardly through the converging nozzle bore 27 and is discharged from the nozzle tip 28 into the nozzle chamber 29, respectively, of the carrier nozzle 26.

Figure 8B:
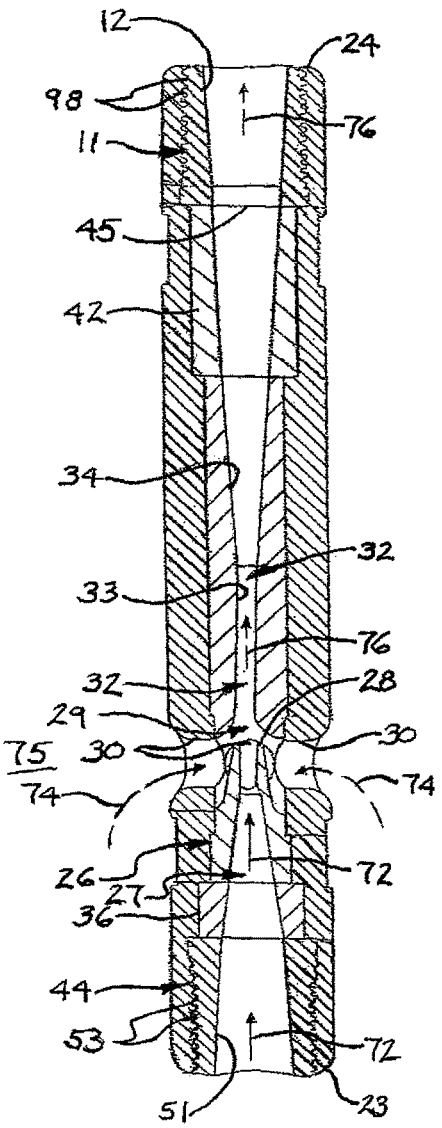
FIG. 8B is an enlarged longitudinal sectional view of the carrier-nozzle mixing tube assembly inside the jet pump assembly, oriented in the second orientation of FIG. 8A, more particularly illustrating flow of power fluid and reservoir fluid in the carrier-nozzle mixing tube assembly in the second fluid flow direction operational mode of the through-accessible high flow capacity reversible operation jet pump.

As illustrated in FIG. 8B, due to the resulting fluid pressure drop in the mixing chamber 32, and other jet flow phenomenon, reservoir fluid 74 is drawn from the reservoir fluid flow space 75 in the pump housing interior 4 through the carrier openings 30 and into the nozzle chamber 29, respectively. The power fluid 72 and the reservoir fluid 74 mix to form the fluid mixture 76, which flows upwardly through the mixing chamber 32, the proximal carrier head bore 12 of the proximal carrier head 11 and the tubing string 58, respectively, to the well surface. As the reservoir fluid 74 is drawn via the power fluid-generated pressure drop from the reservoir fluid flow space 75 through the carrier openings 30 into the nozzle chamber 29, additional reservoir fluid 74 continues to flow upwardly from the well through the suction ports 8 into the reservoir fluid flow space 75. Throughout flow of the fluid mixture 76 upwardly through the jet pump assembly 10 and the tubing string 58, respectively, to the well surface, the power fluid pressure head acts equally in all directions upon the jet pump assembly, and along with the weight of the jet pump assembly and the force required to push the power fluid through the carrier nozzle 26, reacting downwardly against the surface of the pump spool 60, along with the pump mass and the seal friction to retain the jet pump assembly 10 in place in the pump housing 2.

Figure 9:
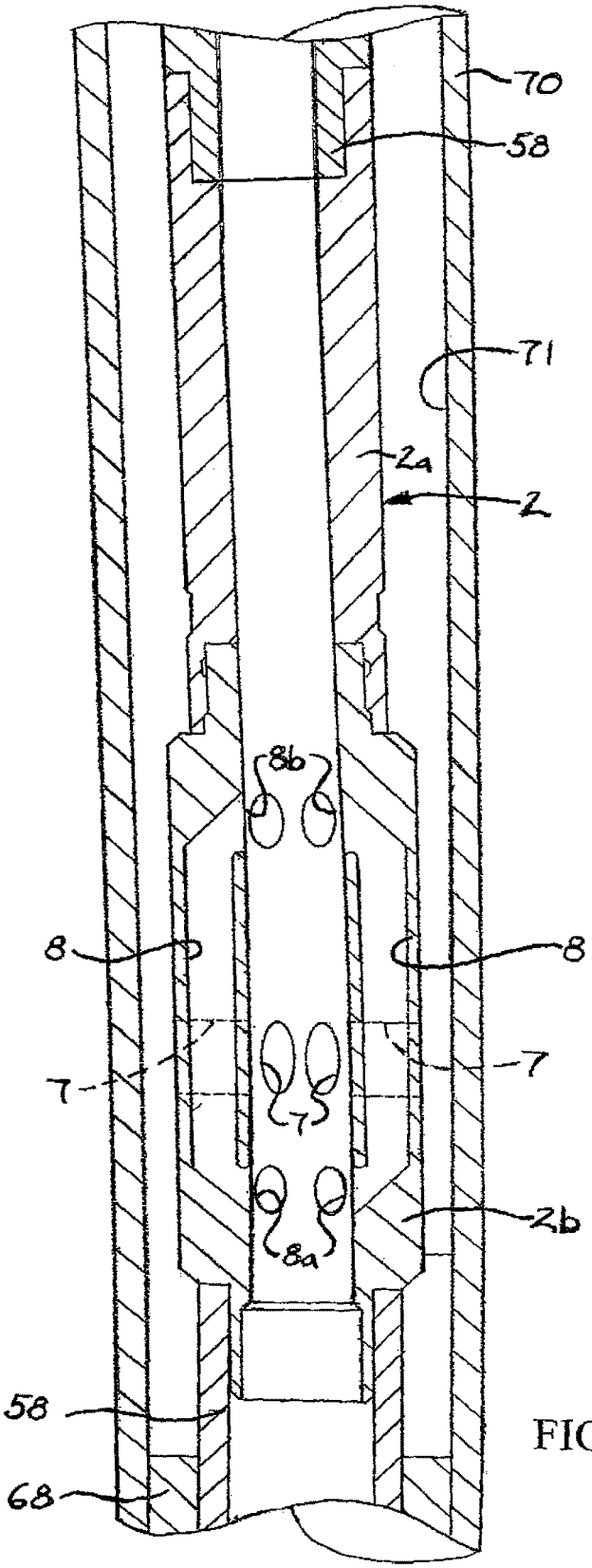
FIG. 9 is a longitudinal sectional view of the pump housing, inside the well casing with the jet pump assembly of the jet pump removed from the pump housing for cleaning or maintenance of depths within the well bore below the pump housing.
Figure 10:
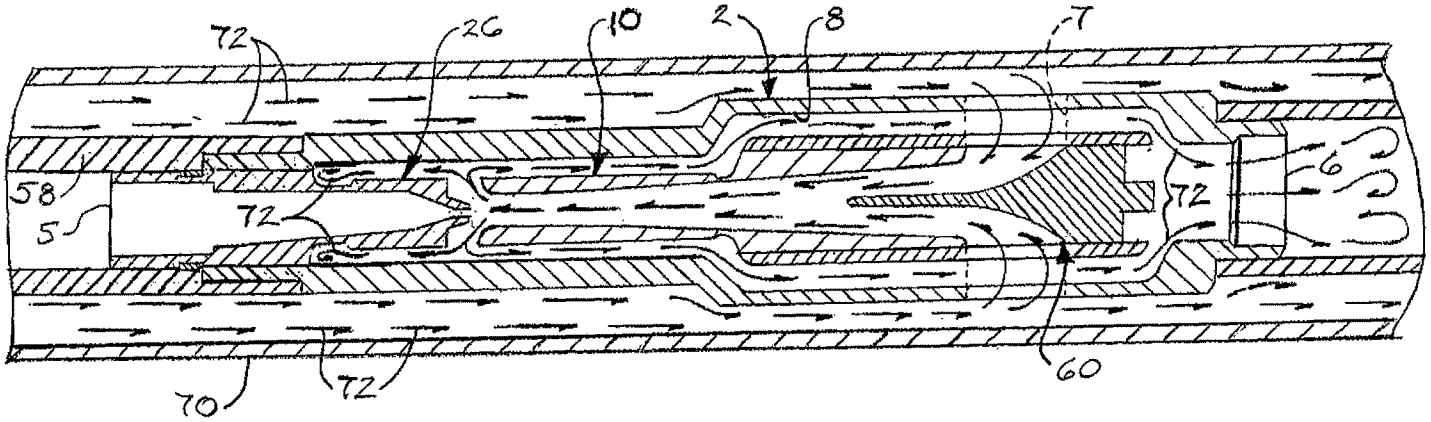
FIG. 10 is a longitudinal sectional view of the well casing, with the reversible operation jet pump disposed in the well casing oriented in the first orientation of FIG. 7A and coupled to a standing valve (shown in FIG. 11), more particularly illustrating typical flow of power fluid in initiating hydraulic retrieval of the reversible operation jet pump from the well casing.
Figure 11:
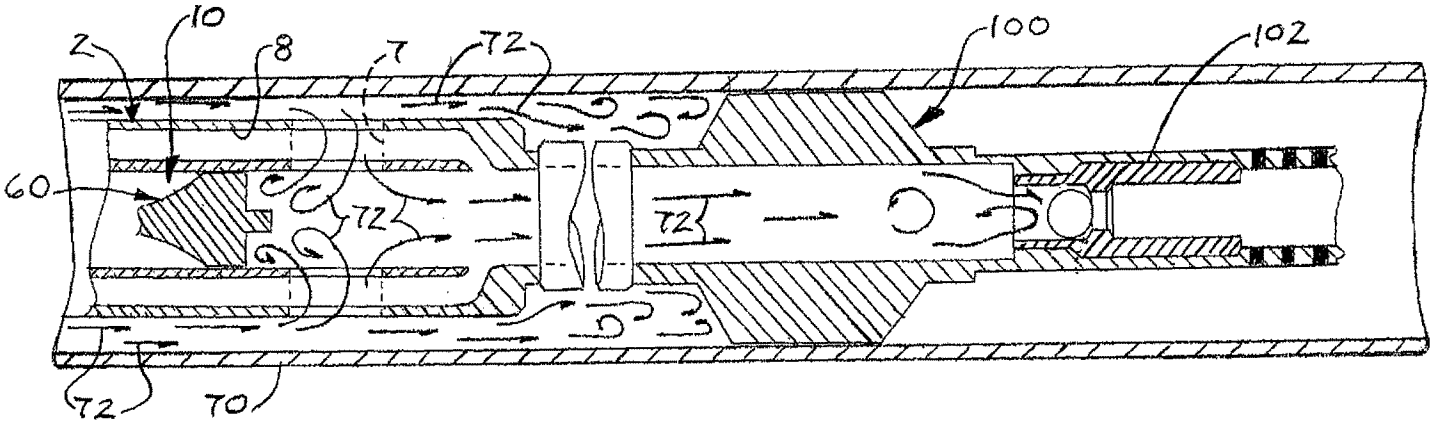
FIG. 11 is a longitudinal sectional view of the well casing and reversible operation jet pump, more particularly illustrating typical flow of power fluid in hydraulic retrieval of the reversible operation jet pump from the well casing.

Referring next to FIGS. 9-11 of the drawings, it will be appreciated by those skilled in the art that when it is deployed in either the first fluid flow direction operational mode (FIG. 7A) or the second fluid flow direction operational mode (FIG. 8A), the jet pump assembly 10 can be selectively removed from the pump housing interior 4 of the pump housing 2 while the pump housing 2 remains deployed on the tubing string 58 in the well casing 70. This expedient facilitates cleaning, maintenance and/or replacement of the jet pump assembly 10, re-orientation of the carrier 22 to facilitate reverse flow through the jet pump assembly 10, and/or clear access to the pump housing, interior 4 and downhole elements of the well through the pump housing interior 4 at clearance matching the I.D. of the tubing for cleaning, maintenance, etc. of the downhole elements of the well below the level of the pump housing 2. Accordingly, when the jet pump assembly 10 is deployed in the first fluid flow direction operational mode (FIG. 7A) for jet pump assembly retrieval, power fluid 72 is initially pumped downwardly through the well annulus 71 and flows through the pump housing openings 7 in the pump housing 2 and the fluid flow spaces 84 in the spool collar 80, respectively. The power fluid 72 flows upwardly through the distal carrier head bore 51 in the distal carrier head 44, the mixing chamber 32 and the carrier openings 30, respectively, and is discharged into the reservoir fluid flow space 75 in the pump housing interior 4. From the reservoir fluid flow space 75, the power fluid 72 flows downwardly through the suction ports 8 in the pump housing 2 and is discharged into the downhole portion of the well at the distal seal retaining collar 79, creating a jet propulsion effect. Pressure builds up against a one-way check valve (standing valve 102, illustrated in FIG. 11) mounted below packer 100 and the jet pump assembly 10 to prevent flow of the fluid deeper into the well beyond the check valve. Continuous flow of power fluid 72 below the jet pump 1 maintains fluid pressure which pushes the jet pump assembly 10 upwardly in the pump housing 2, as illustrated in FIGS. 10 and 11, and through the tubing string 58 to the well surface.

It will be appreciated by those skilled in the art that under circumstances in which the jet pump assembly 10 cannot be retrieved by circulation of the power fluid 72 as in the second fluid flow direction operational mode, as described above for the first fluid flow direction operational mode. a conventional slick line or wire line (not illustrated) can be attached to the proximal carrier head 11 and used to retrieve the jet pump assembly 10 through the tubing string 58. Additionally, the orientation of the carrier 22 in the jet pump assembly 10 can be changed to facilitate flow of the fluid mixture 76 which includes the reservoir fluid 74 to the well surface through the well annulus 71, as was heretofore described with respect to FIG. 7A, or through the jet pump assembly 10, as was heretofore described with respect to FIG. 8A. The same components of the jet pump assembly 10 can be used for flow of the reservoir fluid 74 in either fluid flow direction operational mode. The reversible operation jet pump 1 is amenable to use of top and/or bottom standing valves.

Referring again to FIG. 9 of the drawings, it will be further appreciated by those skilled in the art that the high-capacity flow capability of the reversible jet pump 1 is enabled by the flow-directing capabilities of the suction ports 8 in the pump housing wall 3, the pump spool 60 in the jet pump assembly 10 and fabrication of a pump housing 2 having a pump housing interior 4 with an ID (inner diameter) which matches the ID of the tubing string 58. Accordingly, the reversible jet pump 1 maximizes reservoir fluid-removing capability without sacrificing optimum production of hydrocarbons from the well and access to the well for cleaning and maintenance. In contrast, conventional designs for pumps used to remove reservoir fluid from a well typically have much smaller suction and discharge passages since they must be confined to the cross-sectional area of the I.D. of the pump housing, which restricts the flow capability of the pumps and compromises the reservoir fluid-removing efficiency of the pumps in order to remain within the operational constraints imposed by the desired hydrocarbon production capability and cleaning and maintenance requirements of the well.

In the science and engineering field of hydraulics, the flow of fluids has been studied rigorously for almost two centuries. Dependable and often evolved empirical mathematical formulas exist for fluid flow in pipes, tubes, valves, and various obstacles and fittings. In a downhole jet pump application, there is always limited room for flow of the magnitude required for economical well production, especially since the production fluid has to reverse direction up to 180 degrees in operation. As jet pumps have evolved, the outside diameter of the housing closely mimics that of the production tubing, and in some cases is even less. In consideration of jet pump flow, both production fluid and reservoir fluid must independently move in opposite directions within the space of the internal diameter of the pump housing. Regardless of the various flow paths and port designs, cross-sectional flow area is restricted.

Hydraulic design practice teaches that the smaller the flow passage, the greater the pressure drop with respect to passage length. The well-known basic Darcy's formula for pressure head loss states that:

$$h_L = f(L/D)(v^2/2g),$$

where $h_L$=Static Pressure Head Loss D=Pipe Internal Diameter
f=Friction Factor v=Mean Velocity of Flow
L=Length of Pipe g=Gravitational Accel.

In downhole artificial lift jet pump applications, the jet pump assembly 1 is utilized inside a hollow cylinder, the jet pump housing 2. The jet pump housing 2 is attached to a tubing string or production tubing 58. The tubing string 58, and hence the jet pump assembly 1, is lowered into a well (not illustrated) which is defined geometrically by the well casing 70. The well casing 70 and tubing string 58 are placed concentrically. Standards within the industry establish the size of the well annulus 71 between the well casing 70 and the tubing string 58 or jet pump housing 2. As described elsewhere herein, the well annulus 71 is used by the jet pump assembly 1 and/or the surface pump (not illustrated) to convey power fluid 72, or a fluid mixture 76 of power fluid 72 and reservoir fluid 74, in association with the lifting operation.

By definition, a jet pump functions by very high fluid velocities. These velocities are much higher than those generated by other conventional pump designs.

In downhole operations there are always numerous concerns, in addition to the prior discussion of below-pump maintenance access, which can significantly affect well performance and serviceable life. Among these are degree of solid contaminants, corrosives, entrained gasses within the reservoir fluid, reservoir fluid pressures, scale buildup, and integrity of the casing. Three major operating factors potentially exacerbated by the use of jet pumps are consumption of excess power by the surface power fluid pump, erosion and/or cavitation of jet pump components, and erosive effects from jet pump output on the casing surface.

The power consumption of the power fluid surface pump is largely governed by the efficiency of the jet pump assembly 1. Generation of power fluid pressure must be sufficient to 1) push power fluid mixed with reservoir fluid through the constricted carrier nozzle 26 and mixing chamber 32, 2) generate enough pressure differential within the reservoir fluid 74 to cause suction flow to the mixing chamber 32, and 3) provide adequate pressure to lift the fluid mixture 76 to the well surface through the well annulus 71.

The one established industry-wide geometrical constant in the jet pump design is the configuration of the carrier nozzle 26 with the mixing chamber 32. Beyond this standard, the arrangement of the diffuser, suction ports 8, and pump housing 2 may be arranged for maximizing flow efficiency in terms of flow port sizes and degree of streamlining, or the minimizing of abrupt direction changes. In historical and conventional jet pump designs, pressure and suction ports compete for space within the area of inside diameter of the pump housing. The objective of the discharge port, or diffuser, is to reduce the fluid high velocity generated in the mixing chamber 32 for enhanced control of flow up the well annulus 71 and of the damaging effects of impingement upon the wall of the well casing 70. Greater velocity reduction requires greater cross-sectional flow area, and this infringes on the cross-sectional flow area requirements of the suction ports 8. After the power fluid 72 is pushed through the carrier nozzle 26, suction action is a secondary function of the jet pump 1. The drawing-in of reservoir fluid 74 to the mixing chamber 32 must be sufficient to affect reservoir fluid 74 which is deep within the well, through the standing valve 102 (FIG. 11). Application of the Darcy formula as above indicates that losses are proportional to the squared term of velocity. Pressure losses, and hence, required surface pump power, are sensitive to port size and length. FIGS. 1, 4, 7A, 8A and 9 illustrate suction ports 8 in the pump housing wall 3, thus removed and expanded from the housing interior 4, allowing for maximum spacing, or flow area, for each of the jet pump outlet and suction flows. In this design, both flow areas will be considerably larger than if both remained conventionally within the housing interior 4, allowing for reduced flow velocity, and hence, power fluid pump power requirement.

As noted above, jet pumps inherently operate at high fluid flow velocities. This characteristic renders the jet pump components sensitive to erosion. In addition, the geometry of downhole jet pump systems necessarily includes fluid flow turns and other shape interruptions to preferred streamlined laminar flow. This general high velocity flow irregularity tends to exacerbate erosion to the pump components, and this is accelerated by entrained solids and gaseous contaminants in the fluid.

Cavitation is caused by the constant stretching and compression of the fluid as it flows around turns and over path obstacles in the jet pump. Fluids inherently contain entrained gasses and solid particles. During the stressing of the fluid, at occurrences of low pressure the gas can coalesce and appear as bubbles. As they are carried elsewhere to higher pressure areas, the bubbles implode against the pump surface, causing material removal. Reduced fluid velocity and improved flow streamlining reduce cavitation tendencies.

The well casing in a well is typically considered a permanent fixture and cannot readily be removed. Care is taken to protect the inside diameter surface of the casing. High velocity output from a jet pump in close proximity to the casing could be erosive to the casing. Hence, jet pump housings are conventionally equal in size to the production tubing, leaving as much annular space to the casing as possible. The design of the jet pump 1 which is described herein may utilize an undulating outside diameter of the pump housing 2. This design accomplishes both objectives of generation of large suction ports 8, which are disposed outside the diameter of the pump housing interior 4, and outlet ports, or pump housing openings 7, which are spaced away from the well casing 70 as well as evenly-spaced around the periphery of the pump housing 2 for less concentrated flow into the well 71 annulus and against the well casing 70.

While illustrative embodiments of the disclosure have been described above, it will be recognized and understood that various modifications can be made and the appended claims are intended to cover all such modifications which may fall within the spirit and scope of the disclosure.

What is claimed is:

1. A through-accessible reversible operation jet pump for attachment to a tubing string, comprising:

a pump housing including a pump housing wall and a pump housing interior in said pump housing wall;

at least one suction port in said pump housing wall, said at least one suction port having a suction port inlet and a suction port outlet disposed in fluid communication with said pump housing interior;

at least one pump housing opening extending through said pump housing wall of said pump housing in fluid communication with said pump housing interior; and a jet pump assembly disposed in said pump housing interior, said jet pump assembly including:

a proximal carrier head disposed in sealing engagement with said pump housing wall;

a carrier disposed in fluid communication with said proximal carrier head;

a carrier nozzle in said carrier;

at least one carrier opening in said carrier and establishing fluid communication between said carrier nozzle and said suction port outlet of said at least one suction port through said pump housing interior;

a distal carrier head disposed in sealing engagement with said pump housing wall and having a distal carrier head bore disposed in fluid communication with said carrier; and a pump spool having a tapered spool shaft terminating inside said distal carrier head bore of said distal carrier head, said pump spool disposed in sealing engagement with said pump housing wall between said suction port inlet and said suction port outlet of said at least one suction port;

wherein said pump spool comprises a tool base disposed in fluid communication with said pump housing wall, a tapered spool body extending from said spool base and an elongated, tapered spool tip terminating said spool body, said spool tip terminating inside said distal carrier head bore of said distal carrier head; and a spool collar having a spool caller wall disposed in sealing engagement with said pump housing wall, a plurality of collar vanes connecting said spool collar wall to said snoot body of said pump spool and a plurality of fluid flow spaces between said plurality of collar vanes.

2. The through-accessible reversible operation jet pump of claim 1, wherein said jet pump assembly is adapted to be selectively removed from said pump housing interior through the tubing string as said pump housing remains attached to the tubing string.

3. The through-accessible reversible operation jet pump of claim 2, wherein said carrier of said jet pump assembly is selectively positional in a first orientation in said pump housing interior to facilitate operation of said jot pump in a first fluid flow direction operational mode and said carrier of said jet pump assembly is selectively positional in a second orientation in said pump housing interior to facilitate operation of said jet pump in a second fluid flow direction operational mode opposite said first fluid flow direction operational mode.

4. The through-accessible reversible operation jet pump of claim 1, wherein said carrier nozzle comprises a nozzle chamber and said at least one carrier opening is disposed in fluid communication with said nozzle chamber.

5. The through-accessible reversible operation jet pump of claim 4, wherein said carrier nozzle further comprises a converging nozzle bore converging from said proximal carrier head, a nozzle tip terminating said converging nozzle bore in said nozzle chamber, a straight chamber segment extending from said nozzle chamber and a diverging chamber segment diverging from said straight chamber segment to said distal carrier head.

6. A through-accessible reversible operation jet pump for attachment to a tubing string, comprising:

a pump housing including a pump housing wall and a pump housing interior in said pump housing wall;

at least one suction port in said pump housing wall, said at least one suction port having a suction port inlet and a suction port outlet disposed in fluid communication with said pump housing interior;

at least one pump housing opening extending through said pump housing wall of said pump housing in fluid communication with said pump housing interior; and a jet pump assembly disposed in said pump housing interior, said jet pump assembly including:

a proximal carrier head disposed in sealing engagement with said pump housing wall;

a carrier disposed in fluid communication with said proximal carrier head;

a carrier nozzle in said carrier;

at least one carrier opening in said carrier and establishing fluid communication between said carrier nozzle and said suction port outlet of said at least one suction port through said pump housing interior;

a distal carrier head disposed in sealing engagement with said pump housing wall and having a distal carrier head bore disposed in fluid communication with said carrier;

a pump spool having a tapered spool shaft terminating inside said distal carrier head bore of said distal carrier head, said pump spool disposed in sealing port outlet of said at least one suction port; and at least one distal seal sandwiched between said spool base of said pump spool and said pump housing wall of said pump housing and a distal seal retaining collar threadably engaging said spool base to retain said at least one distal seal in place.

7. A through-accessible reversible operation jet pump, comprising:

a tubing string having an inner tubing string diameter;

a pump housing configured for attachment to said tubing string, said pump housing including a pump housing wall and a pump housing interior in said pump housing wall, said pump housing interior having an inner pump housing interior diameter matching said inner tubing string diameter of said tubing string;

at least one suction port in said pump housing wall, said at least one suction port having a suction port inlet and a suction port outlet disposed in fluid communication with said pump housing interior;

the at least one suction port forms at least one undulation in an exterior surface or outer diameter of the pump housing wall of the pump housing to maximize cross-sectional area for flow of fluid within the pump housing interior;

at least one pump housing opening extending through said pump housing wall of said pump housing in fluid communication with said pump housing interior; and a jet pump assembly disposed in said pump housing interior, said jet pump assembly including:

a proximal carrier head disposed in sealing engagement with said pump housing wall;

a carrier disposed in fluid communication with said proximal carrier head;

a carrier nozzle in said carrier;

at least one carrier opening in said carrier and establishing fluid communication between said carrier nozzle and said suction port outlet of said at least one suction port through said pump housing interior;

a distal carrier head disposed in sealing engagement with said pump housing wall and having a distal carrier head bore disposed in fluid communication with said carrier; and a pump spool having a tapered spool shaft terminating inside said distal carrier head bore of said distal carrier head, said pump spool disposed in sealing engagement with said pump housing wall between said suction port inlet and said suction port outlet of said at least one suction port.

8. The through-accessible reversible operation jet pump of claim 7, wherein said carrier nozzle comprises a nozzle chamber and said at least one carrier opening is disposed in fluid communication with said nozzle chamber.

9. The through-accessible reversible operation jet pump of claim 8, wherein said carrier nozzle further comprises a converging nozzle bore converging from said proximal carrier head, a nozzle tip terminating said converging nozzle bore in said nozzle chamber, a straight chamber segment extending from said nozzle chamber and a diverging chamber segment diverging from said straight chamber segment to said distal carrier head.

10. The through-accessible reversible operation jet pump of claim 7, wherein said jet pump assembly is adapted to be selectively removed from said pump housing interior through said tubing string as said pump housing remains attached to said tubing string.

11. The through-accessible reversible operation jet pump of claim 10, wherein said carrier of said jet pump assembly is selectively positional in a first orientation in said pump housing interior to facilitate operation of said jet pump in a first fluid flow direction operational mode and said carrier of said jet pump assembly is selectively positional in a second orientation in said pump housing interior to facilitate operation of said jet pump in a second fluid flow direction operational mode opposite said first fluid flow direction operational mode.

12. The through-accessible reversible operation jet pump of claim 7, wherein said pump spool comprises a spool base disposed in fluid communication with said pump housing wall, a tapered spool body extending from said spool base and an elongated, tapered spool tip terminating said spool body, said spool tip terminating inside said distal carrier head bore or said distal carrier head.

13. The through-accessible reversible operation jet pump of claim 12, further comprising a spool collar having a spool collar wall disposed in sealing engagement with said pump housing wall, a plurality of collar vanes connecting said spool collar wall to said spool body of said pump spool and a plurality of fluid flow spaces between said plurality of collar vanes.

14. The through-accessible reversible operation jet pump of claim 12, further comprising at least one distal seal sandwiched between said spool base of said pump spool and said pump housing wall of said pump housing and a distal seal retaining collar threadably engaging said spool base to retain said at least one distal seal in place.

15. A through-accessible reversible operation jet pump, comprising:

a tubing string having an inner tubing string diameter;

a pump housing configured for attachment to said tubing string, said pump housing including a pump housing wall and a pump housing interior in said pump housing wall, said pump housing interior having an inner pump housing interior diameter matching said inner tubing string diameter of said tubing string;

a plurality of suction ports in said pump housing wall, said plurality of suction ports each having a suction port inlet and a suction port outlet disposed in fluid communication with said pump housing interior;

the plurality of suction ports form a plurality of undulations in an exterior surface or outer diameter of the pump housing wall of the pump housing to maximize cross-sectional area for flow of fluid within the pump housing interior;

a plurality of pump housing openings extending through said pump housing wall of said pump housing in fluid communication with said pump housing interior; and a jet pump assembly disposed in said pump housing interior, said jet pump assembly including:

a proximal carrier head disposed in sealing engagement with said pump housing wall;

a carrier disposed in fluid communication with said proximal carrier head, said carrier selectively positional in a first orientation in said pump housing interior to facilitate operation of said jet pump in a first fluid flow direction operational mode and selectively positional in a second orientation in said pump housing interior to facilitate operation of said jet pump in a second fluid flow direction operational mode opposite said first fluid flow direction operational mode;

a carrier nozzle in said carrier;

a plurality of carrier openings in said carrier and establishing fluid communication between said carrier nozzle and said suction port outlet of said plurality suction ports through said pump housing interior;

a distal carrier head disposed in sealing engagement with said pump housing wall and having a distal carrier head bore disposed in fluid communication with said carrier;

a pump spool having a tapered spool shaft terminating inside said distal carrier head bore of said distal carrier head, said pump spool disposed in sealing engagement with said pump housing wall between said suction port inlet and said suction port outlet of each of said plurality of suction ports, said pump spool including a spool base disposed in fluid communication with said pump housing wall, a tapered spool body extending from said spool base and an elongated, tapered spool tip terminating said spool body, said spool tip terminating inside said distal carrier head bore of said distal carrier head; and a spool collar having a spool collar wall disposed in sealing engagement with said pump housing wall, a plurality of collar vanes connecting said spool collar wall to said spool body of said pump spool and a plurality of fluid flow spaces between said plurality of collar vanes.

16. The through-accessible reversible operation jet pump of claim 15, further comprising at least one distal seal sandwiched between said spool base of said pump spool and said pump housing wall of said pump housing and a distal seal retaining collar threadably engaging said spool base to retain said at least one distal seal in place.

17. The through-accessible reversible operation jet pump of claim 15, wherein said carrier nozzle comprises a nozzle chamber and said plurality of carrier openings are disposed in fluid communication with said nozzle chamber.

18. The through-accessible reversible operation jet pump of claim 17, wherein said carrier nozzle further comprises a converging nozzle bore converging from said proximal carrier head, a nozzle tip terminating said converging nozzle bore in said nozzle chamber, a straight chamber segment extending from said nozzle chamber and a diverging chamber segment diverging from said straight chamber segment to said distal carrier head.

* * * * *